United States Patent [19]

Schwarb et al.

[11] Patent Number: 4,865,112

[45] Date of Patent: Sep. 12, 1989

[54] METHOD OF CASTING METALS WITH INTEGRAL HEAT EXCHANGE PIPING

[75] Inventors: Charles H. Schwarb, Lake Orion; Raymond E. Schwarb, Berkley, both of Mich.

[73] Assignee: Schwarb Foundry Company, Warren, Mich.

[21] Appl. No.: 216,413

[22] Filed: Jul. 7, 1988

[51] Int. Cl.[4] ..... B22D 19/00

[52] U.S. Cl. ..... 164/34; 164/108; 164/112

[58] Field of Search ..... 164/34, 35, 36, 98, 164/108, 112, 137

[56] References Cited

U.S. PATENT DOCUMENTS

| | | | |
|---|---|---|---|
| 3,756,303 | 9/1973 | Valdo | 164/98 |
| 4,285,385 | 8/1981 | Hayashi et al. | 164/34 |
| 4,436,139 | 3/1984 | Strader | 164/112 |

FOREIGN PATENT DOCUMENTS

| | | | |
|---|---|---|---|
| 43-19001 | 8/1968 | Japan | 164/112 |

OTHER PUBLICATIONS

Plastics Machinery & Equipment vol. 14, No. 11 pp. 42–43, Nov. 1985 Schwarts Foundary Information Sheet "New Plastic Mold Technology".

*Primary Examiner*—Richard K. Seidel
*Attorney, Agent, or Firm*—Peter D. Keefe

[57] ABSTRACT

A method for casting molten metal in a mold having integral heat exchange piping. A mold is provided around a pattern, which may be either the disposable or permanent kind. Heat exchange piping is providing by bending seamless carbon steel pipes and placing the pipes into the mold. According to the method of the present invention, during the casting step, the pipes are simultaneously held at selected locations within the mold by hangers that are affixed to the mold, and allowed to expand at their ends into expansion cavities in the mold.

27 Claims, 4 Drawing Sheets

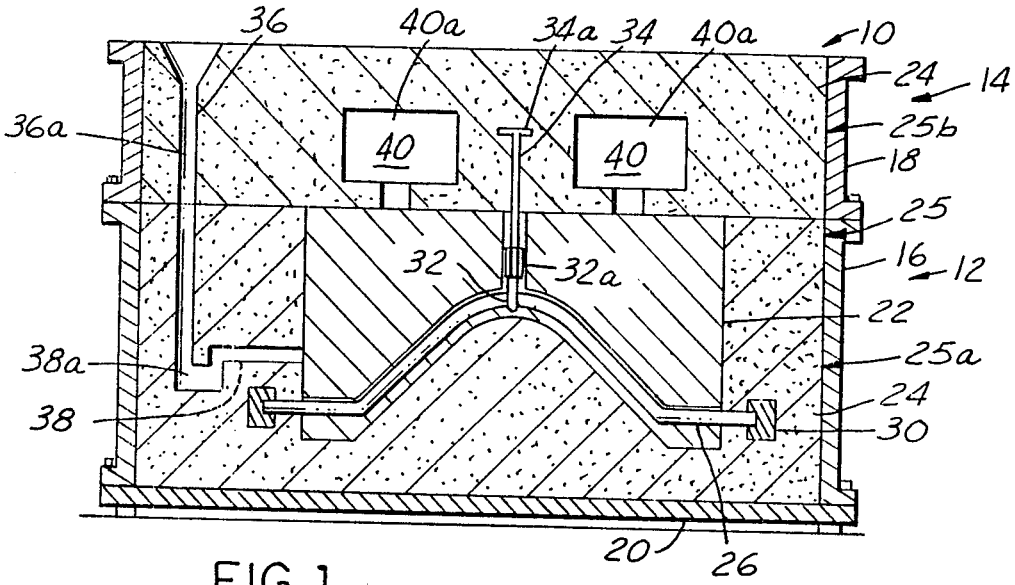
FIG. 1
FIG. 2
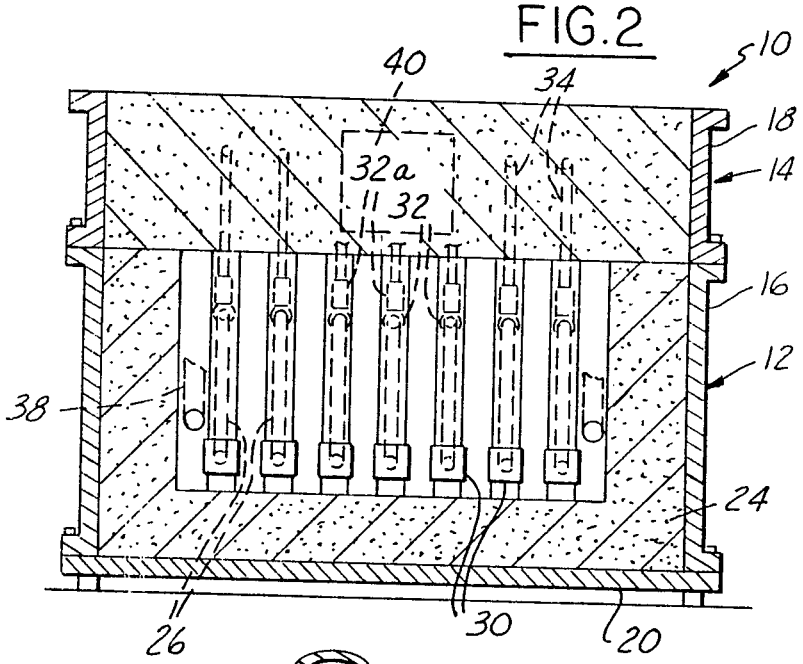
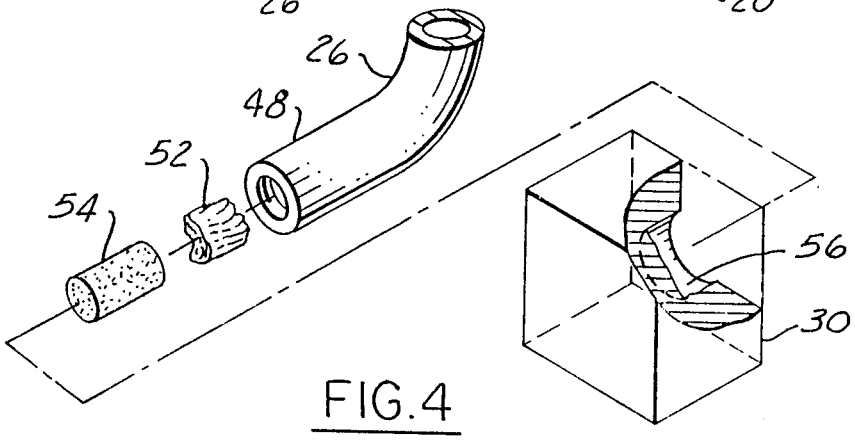
FIG. 4

METHOD OF CASTING METALS WITH INTEGRAL HEAT EXCHANGE PIPING

BACKGROUND OF THE INVENTION

1. Field of the Invention

The present invention relates to metal casting methods utilizing sand molding processes, and more particularly to a sand molding process which includes a method for providing pre-shaped heat exchange piping in the sand mold before casting of the metal thereinto. The present invention is specifically directed to a method for predictably and successfully accommodating heat expansion of the aforesaid piping in response to casting of the metal into the sand mold.

2. Description of the Prior Art

It is well known in the art to cast metals in a predetermined shape through the use of sand molding techniques. Typically, the conventional sand molding process utilizes a pattern which is used to shape a sand mold that is then used to define the shape of the cast metal. The type of pattern used may be disposable or permanent, the use of one or the other defining which steps are to be followed in the casting process.

The typical steps followed when a disposable pattern is used are: A disposable pattern is fabricated to specification; the pattern is typically formed out of the polystyrene family of materials, foundry grade polystyrene being preferred. The pattern is covered by a refractory coating and placed on a molding board. A box known as a "drag flask" is placed on the molding board. Foundry sand is poured into the drag flask, during which it is rammed around the outer edge of the pattern and rammed generally inside the drag flask. Before the drag flask is filled, a "gate" is provided by positioning an appropriately shaped polystyrene material adjacent the disposable pattern. The drag flask is filled and the sand leveled off. A bottom board is now placed on the top of the flask. The drag flask is then inverted so as to rest on the bottom board. The molding board is removed and a "cope flask" is placed above the drag flask. To provide passage of the molten casting metal into the pattern, a "sprue" is provided in the cope flask by insertion of an appropriately shaped polystyrene material adjacent the gate. Next, a "riser" is provided in the cope flask to accommodate contraction of the molten casting metal by placement of an appropriately shaped polystyrene material adjacent the disposable pattern. Foundry sand is then poured into the cope flask and rammed as described above. The mold is now ready for casting metal in the shape of the pattern by introduction of molten casting metal into the sprue.

The typical steps followed when a permanent pattern is used are: A permanent pattern is fabricated to specification; the pattern is typically made of wood, but may also be made of other durable materials, such as metal, plastic, plaster or clay. The pattern is placed on a molding board. A drag flask is then placed on the molding board. Parting compound is dusted over the pattern. Foundry sand is poured into the drag flask and rammed about the pattern edges and rammed generally within the drag flask. The foundry sand is leveled off and a bottom board placed over the drag flask. The drag flask is then inverted so as to rest on the bottom board. The molding board is removed and a cope flask placed on the drag flask. A riser pin and a sprue pin are provided in the cope flask adjacent the pattern. Foundry sand is poured into the cope flask and rammed as described above. The pins are removed from the cope portion of the mold and the cope is then removed and carefully set down elsewhere. The pattern is gently lifted from the drag portion of the mold, and the cavity resulting therefrom is covered by a refractory coating. A gate is cut in the drag portion of the mold so as to connect with the sprue of the cope portion of the mold. The cope is now replaced above the drag. The mold is now ready for casting metal in the shape of the pattern by introduction of molten casting metal into the sprue.

While these processes are very successful for the casting of metals, they do not inherently provide for heat exchange channels in the metal casting. Frequently, however, the metal casting must be provided with heat exchange channels which run proximately with the surface of the metal casting. This requirement may arise, for example, when the metal casting is to be used as a die for plastic injection molding. Conventionally, these channels are provided by boring or routing into the metal casting subsequent to its casting in the sand mold. Examples of this technique are disclosed by Summers U.S. Pat. No. 3,572,420, Auman et al U.S. Pat. No. 3,763,920 and Alberny U.S. Pat. No. 4,009,749. Alternatively, an external heat exchange jacket may provided which surrounds the metal casting. Examples of this latter technique are disclosed in Wertli U.S. Pat. No. 3,530,926, Adamec et al U.S. Pat. No. 3,592,259 and Sevastakis U.S. Pat. No. 4,493,361. In either case, these provisions for heat exchange channeling for the metal casting are very expensive and labor intensive. What is needed is a method for providing heat exchange channels at the time that the metal casting is being cast.

The present inventor has been in the foundry business for many years and has long been engaged in seeking a reliable, predictable and successful method of casting metals with integral heat exchange piping. In an article published in the periodical *Plastics Machinery & Equipment*, Vol. 14, No. 11, pages 42 and 43 (Nov. 1985), entitled "Casting Technique Reduces Costs of Molding", an early, experimental method developed by the inventor is disclosed. In this method a foam pattern is used. The method is as follows:

" . . . The foam pattern is placed in a chemically bonded sand mold. The sand chemically joins itself around the pattern, and then seats into the exact dimensions of the foam pattern. Schwarb Foundry's proprietary metal is heated in a furnace and then poured over the foam mold, the pattern evaporates into gas, and the mold cavity is filled with metal. . . . The metal then cools, forming the cavity or core of the cast mold.

"Steel pipes for heating or cooling are positioned within the foam pattern. The molten metal is poured over the pipes without melting them. As the metal cools, it solidifies around the pipes, providing cooling lines in the cast mold. . . .

"The key to this casting technique lies in two factors: first, the composition of the metal and, second, the pouring technique, both proprietary. The purported savings realized in cast molds over conventionally made molds lies in the amount of purchased metal to be machined. In conventional moldmaking, two solid blocks of P20 or similar steel are used to make the cavity and the core. Deep-draw cavities require significant amount of stock removal. The cast molds require matching off only 0.375 to 0.5 inch of steel to prepare the mold. . . . "

However, while the concept of including heat exchange piping within the pattern cavity prior to the casting step was disclosed in this article, there was no mention therein of how to deal with unpredictable and uncontrolled expansion movements of the piping when the molten casting metal came into contact with it. This severe and debilitating problem was addressed by the inventor in several ways before arriving at the method disclosed by the present invention.

One method proffered by the inventor was to control heating of the pipes by blowing a high volume of air through the pipes during the casting step. This proved to be workable, but there was still unpredictable pipe movement and the air flow system was costly to install and operate.

What is needed, therefore, is a method for casting metals utilizing sand mold techniques by which heat exchange piping may be provided contemporaneously with the casting step and heat expansion movements of the aforesaid piping during the casting step may be predictably accommodated with a minimum of time and expense.

SUMMARY OF THE INVENTION

The present invention is a method for casting metals with integral heat exchange piping. The present invention overcomes the problem in the prior art of controlling the expansion movements of the heat exchanging piping so that the resulting metal casting is of high and predictable quality.

The method according to the present invention uses sand casting processes with either disposable or permanent patterns.

In the case of the method of the present invention being utilized with a disposable pattern, the following steps are performed:

A disposable pattern is fabricated to specification; the pattern is preferably formed out of foundry grade polystyrene. Heat exchange pipes are bent to follow a selected surface of the pattern. The disposable pattern is preferred to be segmented and the segments are selectively routed out to allow the pipes to be selectively inserted thereinto. The ends of the pipes are plugged by wadding and sand, and are then covered by polystyrene blocks. Hangers are selectively attached to the pipes. The disposable pattern is covered with a refractory coating and is placed on a molding board. A drag flask is placed on the molding board. Foundry sand is poured into the drag flask, during which it is rammed around the outer edge of the pattern and rammed generally inside the drag flask. Before the drag flask is filled, a gate is provided by placing a polystyrene material adjacent the disposable pattern. The gate configuration is selected to insure molten metal will enter the disposable pattern without squirting, that is, under low pressure and at a slow rate of efflux. It is preferred that the molten metal enter the disposable pattern in a direction parallel with respect to the local orientation of the pipes. The drag flask is filled and the sand leveled off. A bottom board is now placed on the top of the flask. The drag flask is then inverted so as to rest on the bottom board. The molding board is removed and an anchor rod is connected with each of the aforesaid hangers. A cope flask is placed above the drag flask, the anchor rods extending into the cope flask. To provide passage of the molten casting metal into the pattern, a sprue is formed in the cope by insertion of a polystyrene material adjacent to the gate. Next, at least one riser is provided in the cope flask to accommodate contraction of casting metal by placement of an appropriately shaped polystyrene material adjacent the disposable pattern. Foundry sand is then poured into the cope flask and rammed as described above. The mold is now ready for casting metal in the shape of the pattern by introduction of molten casting metal into the sprue. When molten metal enters the pattern, the polystyrene is vaporized and the pipes predictably expand. Expansion of the pipes is predictable because of the coaction between the expansion joints provided by the polystyrene blocks at each end of the pipes and the hangers. Upon solidification of the metal casting, the pipes assume a predetermined configuration integral the casting.

In the case of the method of the present invention being utilized with a permanent pattern, the following steps are performed:

A permanent pattern is fabricated to specification; the pattern is typically made of wood, but may also be made of metal, plastic, plaster or clay. The pattern includes a core print at selective locations in which heat exchange pipes are predetermined to emerge from the pattern cavity. A parting compound is dusted on the permanent pattern and it is placed on a molding board. A drag flask is then placed on the molding board. Foundry sand is poured into the drag flask and rammed about the pattern edges and rammed generally within the drag flask. The foundary sand is leveled off and a bottom board placed over the drag flask. The drag flask is then inverted so as to rest on the bottom board. The molding board is removed and a cope flask placed on the drag flask. A riser pin and a sprue pin are provided in the cope adjacent the pattern. Further, a number of dowls are provided in the cope to allow for anchor rods that will be installed later. Foundry sand is poured into the cope flask and rammed as described above. The pins and dowls are removed from the cope part of the mold and the cope is then removed and carefully set down elsewhere. The pattern is gently lifted from the drag portion of the mold, and the pattern cavity formed by removal of the permanent pattern is covered with a refractory coating. A gate is cut in the drag portion of the mold so as to connect with the sprue of the cope portion of the mold. Pre-bent heat exchange pipes are placed in the pattern cavity in the drag portion of the mold. Each of the pipes has a selected number of hangers attached to it. Each end of the pipes is provided with a polystyrene block and rests in an indentation provided by the core print. A core box is used to prepare foundry sand molds which are used to fill the remaining portions of the indentations created by the core print in the drag portion of the mold. The gate is structured so that molten metal will enter into the pattern cavity without squirting, that is, under low pressure and at a slow rate of efflux. It is preferred that the molten metal enter the cavity in a direction that is parallel with respect to the local orientation of the pipes. The cope is now replaced above the drag. Anchor rods are now inserted into the holes left behind by the dowls and are connected to respective hangers. The anchor rods are then secured to the cope. The mold is now ready for casting metal in the shape of the pattern by introduction of molten casting metal into the sprue. When molten metal enters the pattern cavity, the pipes predictably expand. Expansion of the pipes is predictable because of the coaction between the expansion joints provided by the polystyrene blocks at each end of the pipes and the hangers. Upon solidification of the metal casting, the pipes assume a predetermined configuration integral the casting.

Accordingly, it is an object invention to provide a method for casting metals with integral heat exchange pipes located therein.

It is a further object of the present invention to provide a method for predictably managing heat expansion induced movements of heat exchange pipes while the aforesaid pipes are being cast within a metal casting.

These, and additional objects, advantages, features and benefits of the present invention shall become apparent from the following specification.

BRIEF DESCRIPTION OF THE DRAWINGS

FIG. 1 is a sectional side view of a sand mold metal casting system having a disposable pattern according to the method of the present invention.

FIG. 2 is a sectional end view of the sand mold metal casting system of FIG. 1.

FIG. 4 is an exploded detail view of an end of a heat exchange pipe about to be packed with wadding and then placed against a polystyrene block according to the method of the present invention.

DETAILED DESCRIPTION OF THE PREFERRED EMBODIMENT

Figure 3:
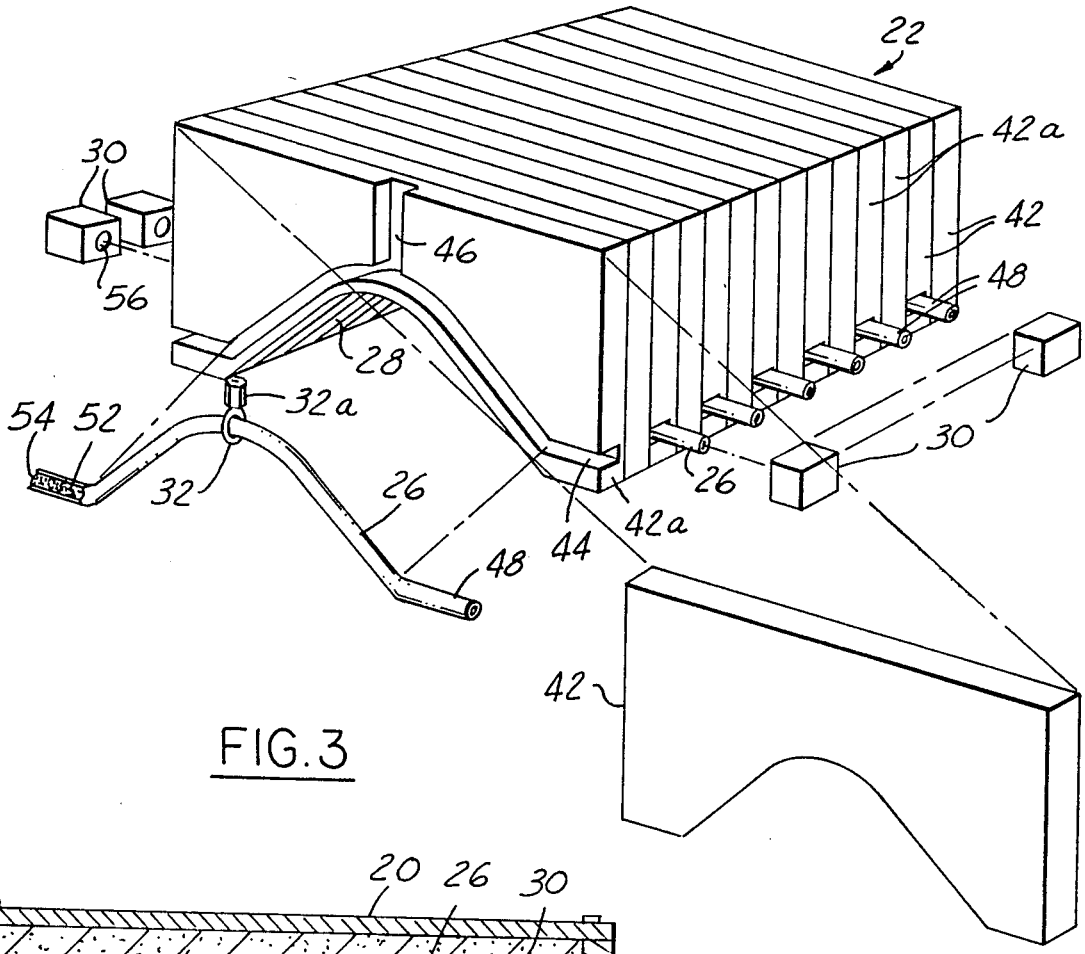
FIG. 3 is a part exploded perspective view of the method of inserting heat exchange pipes within a disposable pattern according to the method of the present invention.

The present invention is a method for casting metals with integral heat exchange piping being provided at the time the casting step is performed. The preferred method of carrying out the present invention includes two essential steps: providing for pipe expansion at the ends of the pipe and providing for pipe anchorage at selected locations between the ends of the pipe. This method is preferred to be carried out in conjunction with sand mold casting processes, but is not restricted to this environment. With respect to describing the best mode for carrying out the method of the present invention, two sand mold casting processes will be sequentially described: sand mold casting utilizing a disposable pattern, and sand mold casting utilizing a permanent pattern.

Referring now to FIGS. 1 through 9, the method according to the present invention for providing sand mold casting of metal with integral heating and cooling pipes using a disposable pattern will be disclosed.

FIG. 1 shows a completed sand mold system 10 ready for molten metal casting. The mold system 10 is composed of two parts, a drag 12 and a cope 14. The drag is defined by a drag flask 16 and the cope is defined by a cope flask 18. The drag flask rests on a bottom board 20 and the cope flask rests directly above the drag flask. A disposable pattern 22 is located in the drag and is surrounded by foundry sand 24, the foundry sand being located in both the drag 12 and the cope 14, thereby forming a mold 25 having a drag portion **25*a* and a cope portion 25*b*. Within the disposable pattern 22 is at least one heat exchange pipe 26 which has been pre-bent in order to follow a selected working surface 28 of the disposable pattern, this surface corresponding to a functional surface of the anticipated metal casting which will need heat exchange provisions. Polystyrene pipe expansion blocks 30 are provided at each end of the pipe 26. These blocks permit the pipe to expand in a predictable manner when molten metal is poured into the mold 25. A hanger 32 is connected to the pipe 26 and the hanger is anchored to the cope portion of the mold 25*b* by an anchor rod 34. For this purpose, the anchor rod is preferred to have a transverse portion 34*a* which aids anchoring the anchor rod 34 in the cope portion of the mold 25*b*. The hanger and its associated anchor rod control heat expansion movement of the pipe 26 within the disposable pattern so that the pipe will remain in a predictable proximity to the working surface 28. A sprue 36 is provided in the cope portion of the mold 25*b* and the sprue connects to a gate 38 provided in the drag portion of the mold 25*a*. The sprue provides an entry port for the molten metal and the gate is structured to allow low velocity flow of the molten metal into the disposable pattern 22 without squirting. It is preferred that the molten metal flow in a direction which is locally parallel with respect to the orientation of the pipe 26. Risers 40 are provided in the cope portion of the mold 25*b*** in order to ensure that as the molten metal cools and, consequently, contracts, that a reservoir of molten metal will be available to compensate therefor.

FIG. 2 is an end view of the sand mold system 10, now showing that there are seven heat exchange pipes 26 arranged in mutually parallel orientation within the disposable pattern 22.

FIG. 3 discloses how the disposable pattern 22 is modified to include the heat exchange pipes 26. The disposable pattern 22 is fabricated according to predetermined dimensional specifications. The disposable pattern is preferred to be constructed of foundry grade polystyrene having a density of one pound per cubic foot, although other forms of vaporizable material can be used, such as common styrofoam. Determining factors in choice of disposable pattern materials include surface texture, vaporizability, residue and workability. It is preferred, although not required, that the foundry grade polystyrene be constructed as a series of segments 42 held together by a removable mechanical fastener, such as a wire (not shown). Based upon heat exchange requirements specified for the metal casting, a selected number of segments 42a are removed from the disposable pattern and each of these selected segments 42a are provided with a pipe groove 44, preferably by routing, to accommodate heat exchange pipes 26. Further, an anchor groove 46 is provided in the selected segments 42a to later accommodate the hanger 32 and its associated anchor rod 34. A pipe 26 is bent to follow the pipe groove 44 in a respective segment 42a. The pipe groove 44 in many common situations will follow the working surface 28. To perform this step, it is preferred that a template be prepared for each pipe groove, and that each pipe be individually bent according to its template. After bending, the pipe 26 should follow the pipe groove 44 and extend outside the pipe groove at either end 48 approximately four inches. The heat exchange pipe 26 is selected to be able to provide good heat transfer, ease of bending and resistance to failure caused both by bending and contact with molten metal during the casting step. It is preferred that a 1020 cold-drawn seamless steel pipe be used having three-eighths inch wall thickness. An example of such a pipe is a commercial grade seamless carbon steel pipe having a 1.25 inch O.D. and a 0.5 inch I.D., and having a weight per foot of approximately 3.5 pounds.

Pipe hangers 32 are installed at selected intervals along the pipe 26. The pipe hangers are preferred to be steel "eye" bolts through which the pipe is slipped. The pipe hangers must be thick enough to survive contact with the molten metal during the casting step, and they are arranged along the pipe preferably every eighteen inches. At the top of the pipe hanger is an elongated nut 32a which will later permit the anchor rod 34 to be threadingly secured to the pipe hanger 32.

Each pipe 26 is placed in its respective groove 44 of a respective grooved segment 42a. Care must be taken to ensure that there is no oil or rust on the pipe surfaces. All the segments 42 are reassembled on a molding board 50, and then glued together to form a disposable pattern 22 having integral heat exchange piping.

As further shown in FIG. 4, the pipes 26 are plugged with wadding 52 several inches distance into each end of the pipe, the wadding being preferably being made of a mineral wool. The remaining free portion of the pipe ends are then filled with sand 54, preferably a refractory sand. The wadding and sand combine to prevent any molten casting metal from entering the ends of the pipes 26 during the casting step to follow. Polystyrene expansion blocks 30 are then placed on each end of the pipes 26. For this purpose, a notch 56 may be provided in the expansion block so that the expansion blocks will friction fit over the pipe end.

Figure 5:
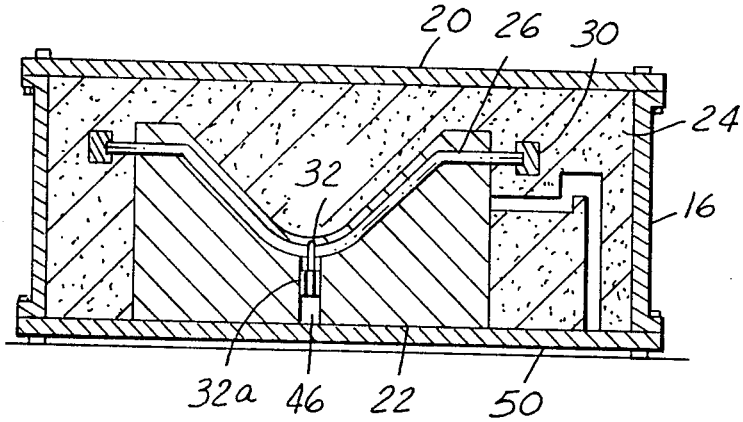
FIGS. 5 and 6 are sectional side views of the drag portion of a sand mold made according to the method of the present invention.
Figure 6:
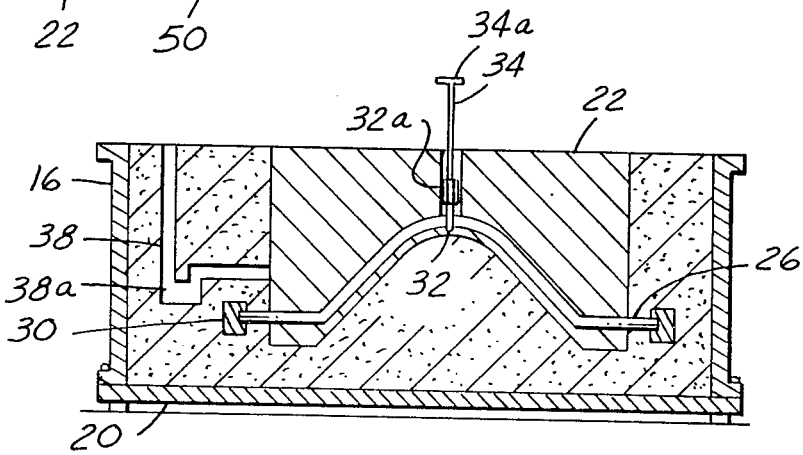
Figure 7:
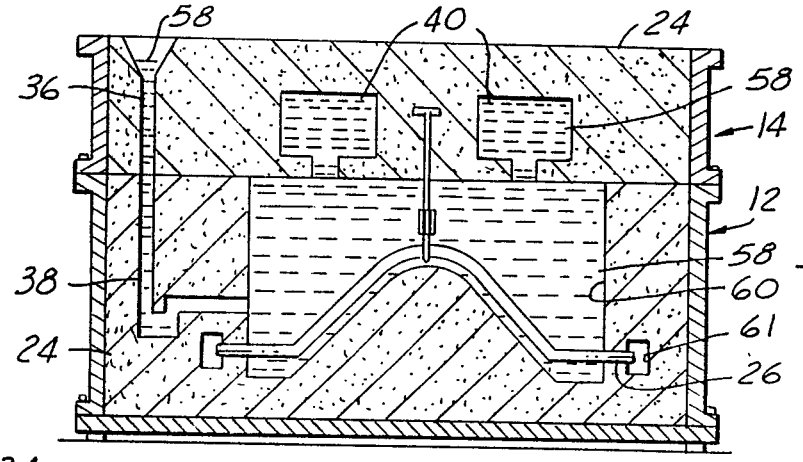
FIG. 7 is a sectional side view of a sand mold made with a disposable pattern, showing the drag and cope portions, made according to the method of the present invention.

FIGS. 5 through 7 show how the sand mold system 10 is prepared according to the method of the present invention. The disposable pattern 22 is now coated with a refractory coating and the drag flask 16 is mounted to the molding board 50. Foundry sand 24 is poured into the drag flask, during which it is rammed around the outer edge of the disposable pattern 22 and rammed generally inside the drag flask. Before the drag flask 16 is filled, the gate 38 is provided by a gate shaped polystyrene material 38a located adjacent the disposable pattern 22. The gate pattern 38 is structured to insure molten metal will enter the disposable pattern 22 without squirting, that is, under low pressure and at a low rate of efflux. This can be achieved by providing gate orifices of a sufficient size and number. It is preferred that the molten metal enter the disposable pattern in a direction parallel with respect to the local orientation of the pipes 26. The drag flask 16 is filled and the foundry sand 24 leveled off, the drag portion of the mold 25a now being completed. The bottom board 20 is now placed on the top of the drag flask, as shown in FIG. 5. The drag flask is then inverted so as to rest on the bottom board 20, as shown in FIG. 6. The molding board 50 is removed and each anchor rod 34 is threaded onto its respective pipe hanger 32 by engagement with its associated elongated nut 32a. The cope flask 18 is placed above the drag flask, the anchor rods extending into the cope flask. To provide passage of the molten casting metal into the gate shaped polystyrene material 38a and disposable pattern 22, a sprue 36 is formed in the cope by providing a sprue shaped polystyrene material 36a adjacent to the gate pattern 38a. Next, at least one riser 40 is provided in the cope to accommodate contraction of molten casting metal by placement of an appropriately shaped polystyrene material 40a adjacent the disposable pattern 22. The number of risers is determined by the anticipated contraction of the molten casting metal in the disposable pattern during the casting step. The drawing figures show an example where two risers are utilized. Foundry sand 24 is then poured into the cope flask 18 and rammed as described above, thereby forming the cope portion of the mold 25b. The sand mold system 10 is now ready for casting metal in the shape of the disposable pattern 22 by introduction of molten casting metal into the sprue.

Figure 9:
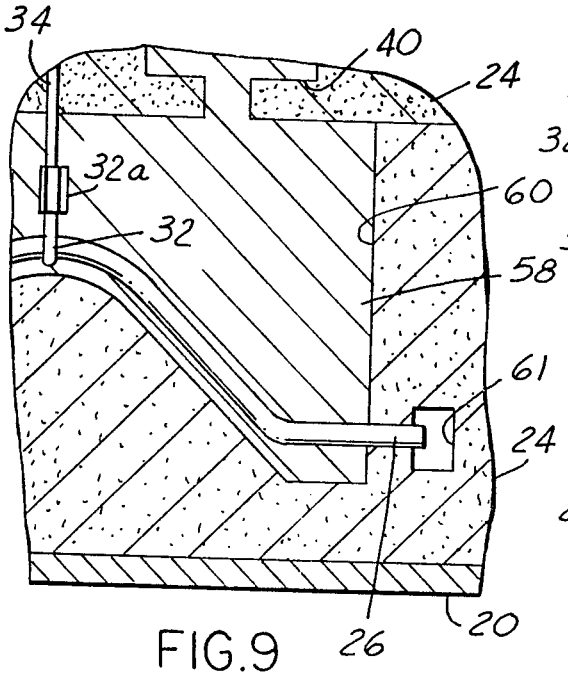
FIGS. 8 and 9 are part sectional side views showing extrema for heat induced expansion and contraction movement of the heat exchange pipes during the casting step according to the method of the present invention.
Figure 8:
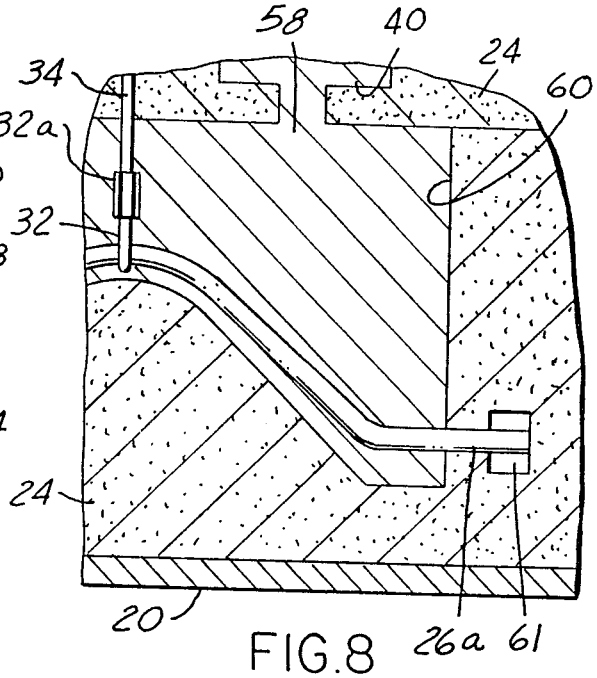
Figure 10:
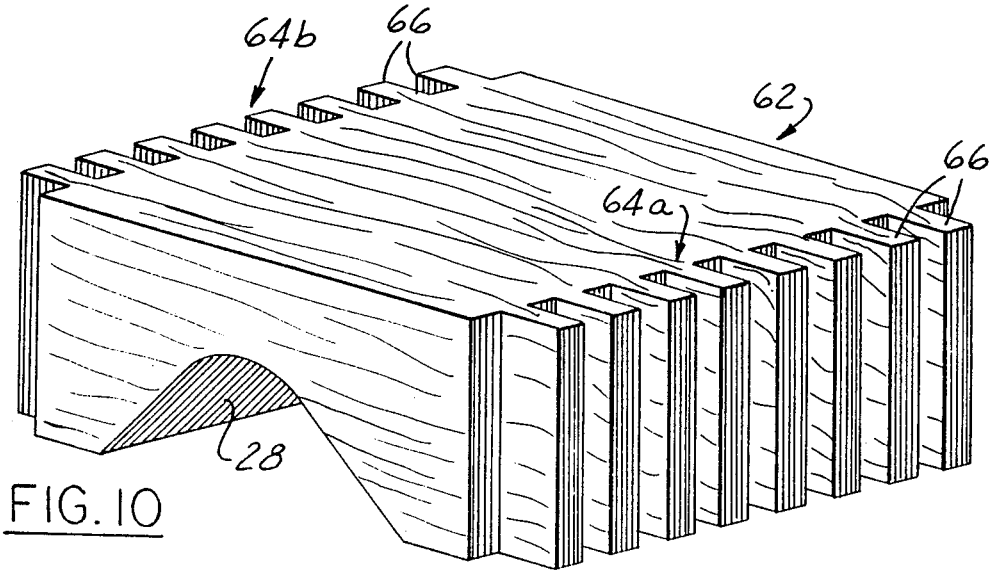
FIG. 10 is a perspective view of a permanent pattern including a core print according to the method of the present invention.
Figure 11:
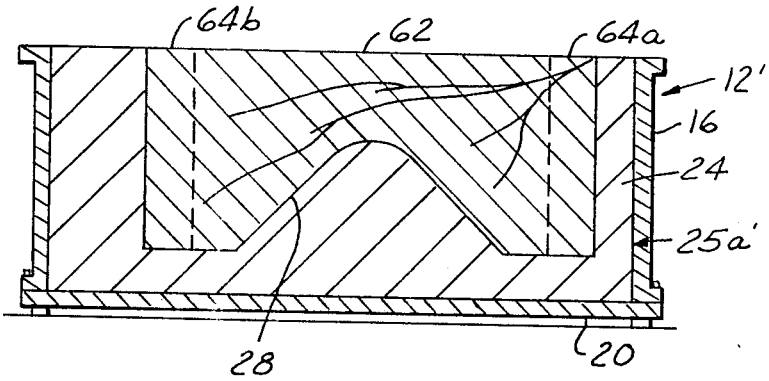
FIG. 11 is a sectional side view of the drag portion of a sand mold with a permanent pattern according to the method of the present invention.
Figure 12:
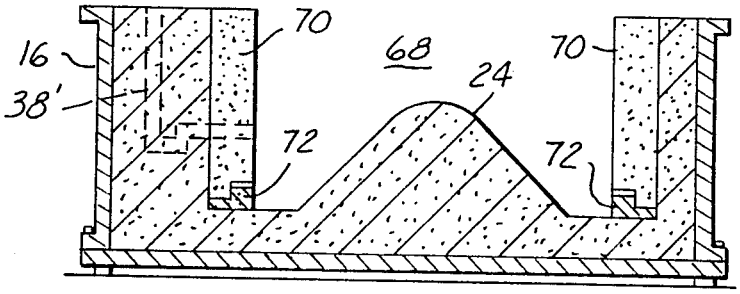
FIG. 12 is a sectional side view of the drag portion of the sand mold of FIG. 11 with the permanent pattern now removed.

When molten casting metal 58 enters the mold 25, a pattern cavity 60 formed by the vaporization of the disposable pattern 22 during the casting step is filled, the polystyrene materials 36a, 38a and 40a are vaporized, and the pipes 26 predictably expand. Expansion of the pipes, as shown in FIG. 8, is predictable because of the coaction between expansion cavities 61 created upon vaporization of the polystyrene expansion blocks 30 at each end of the pipes, and pipe anchorage provided by the hangers 32 and their associated anchor rods 34. Upon solidification of the molten casting metal 58, the pipes 26 assume a predetermined configuration, as shown in FIG. 9, integral the casting.

Referring now to FIGS. 10 through 15, the method according to the present invention for providing sand mold casting of metal with integral heating and cooling pipes using a permanent pattern will be disclosed. In the interest of continuity and simplicity, similar parts to those used in the hereinabove described method involving disposable patterns will be given the same part numbers.

Figure 13:
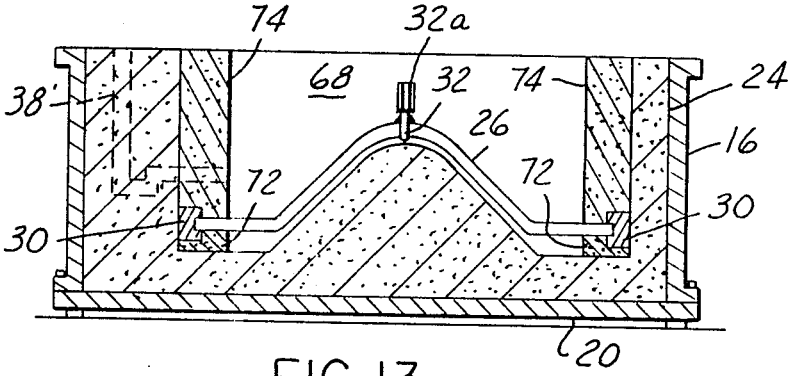
FIG. 13 is a sectional side view of the drag portion of the sand mold of FIG. 12 with heat exchange pipes now installed according to the method of the present invention.
Figure 14:
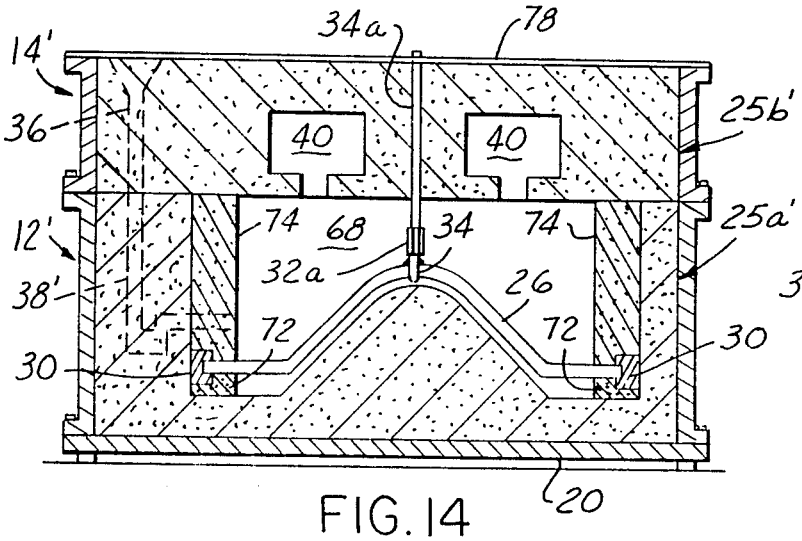
FIG. 14 is a sectional side view of a sand mold made with a permanent pattern, showing the drag and cope portions, made according to the method of the present invention.
Figure 15:
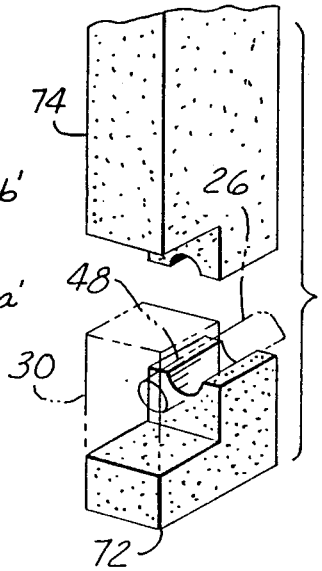
FIG. 15 is a detail perspective view showing placement of a heat exchange pipe in the drag portion of the sand mold of FIG. 14 according to the method of the present invention.

A permanent pattern 62 is fabricated to predetermined dimensional specifications; the permanent pattern is preferred to be made of wood, but may also be made of metal, plastic, plaster, clay, or some other suitable, durable material. The permanent pattern 62 includes a core print 64a and 64b located respectively at either end thereof. The core prints have bosses 66 which will provide columnar indentations in the drag portion of the mold 25a' so that heat exchange pipes 26 may be later installed. The permanent pattern 62 is dusted with a parting compound and placed on a molding board 50. A drag flask 16 is then placed on the molding board. Foundry sand 24 is poured into the drag flask and rammed about the pattern edges and rammed generally within the drag flask. The foundry sand is leveled off and a bottom board 20 placed over the drag flask. The drag flask is then inverted so as to rest on the bottom board. The molding board is removed and a cope flask 18 is placed on the drag flask. A riser pin and a sprue pin (not shown) are provided in the cope adjacent the permanent pattern 62. Further, a number of anchor rod dowls (not shown) are provided in the cope to allow for anchor rods 34' that will be installed later. Foundry sand 24 is poured into the cope flask and rammed as described above. The pins and dowls are removed from the cope part of the mold **25*b'* and the cope 14' is then removed and carefully set down elsewhere. The permanent pattern 62 is gently lifted from the drag portion of the mold 25*a'* and the pattern cavity 68 left behind is covered by a refractory coating. A gate 38' is cut in the drag portion of the mold so as to connect with the sprue 36 of the cope portion of the mold. Pre-bent heat exchange pipes 26, bent to conform as needed with the working surface 28, are placed in the pattern cavity 68 in the drag portion of the mold. The heat exchange pipes 26 are seamless carbon steel having a preferred three-eighth inch sidewall, as described hereinabove. Each of the pipes 26 has a selected number of hangers 32 attached to it, preferably spaced eighteen inches apart. Each hanger has an attached elongated nut 32*a*. Each end 48 of the pipes 26 is provided with a polystyrene expansion block 30. The pipes are individually placed in the pattern cavity 68 so that each end 48 rests in a columnar indentation 70 formed in the foundry sand by removal of the core print 64*a* or 64*b*. A core box (not shown) is used to prepare foundry sand molds 72 and 74 which are used to fill the remaining portions of the indentations created by the core print not occupied by either the pipe 26 or its associated polystyrene expansion block 30, as shown in FIGS. 13 through 15. The gate 38' is structured so that molten metal will enter into the pattern cavity 68 without squirting, that is, under low pressure and at a slow rate of efflux. This can be achieved by providing gate orifices of a sufficient size and number. It is preferred that the molten metal enter the pattern cavity 68 in a direction that is parallel with respect to the local orientation of the pipes 26, as described hereinabove. The cope 14' is now replaced above the drag 12', as shown in FIG. 14. Anchor rods 34' are now inserted into holes 76 left behind by the anchor rod dowls and are threadingly connected to respective elongated nuts 32*a*. The anchor rods 34*a* are then secured to the cope portion of the mold 25*b'* by any convenient manner, such as by welding a plate thereto or threadingly securing a washer thereto. The sand mold system 78 is now ready for casting metal in the shape of the permanent pattern 62 by introduction of molten casting metal into the sprue 36. When molten metal enters the pattern cavity 68, the pipes 26 predictably expand. Expansion of the pipes is predictable because of the coaction between expansion cavities 80 formed by vaporization of the polystyrene blocks 30 at each of the pipes, and the hangers 32 with their respective anchor rods 34*a*, in the manner hereinabove described. Upon solidification of the metal casting, the pipes 26** assume a predetermined configuration integral the metal casting in the manner hereinabove described.

Several considerations should be kept in mind when carrying out the teachings of the present invention. Firstly, the heat exchange pipes should have sufficient wall strength to withstand bending and exposure to the molten casting metal without failure. Secondly, the hangers, elongated nuts and anchor rods must be of sufficient thickness to survive exposure to the molten casting metal; the hangers should be regularly spaced approximately every eighteen inches along the pipes. Thirdly, the gating should be constructed so that molten casting metal flows into the pattern cavity at a slow flow rate and at low pressure so that there will be no squirting that could damage the pipes; it is preferred that the molten metal enter the pattern cavity in a direction locally parallel with the pipes. Fourthly, the pipes must be provided room to expand at either end, either by simply providing a cavity in the foundry sand or by placing a vaporizable material, such as polystyrene, in the foundry sand. Fifthly, the casting metal can include any non-ferrous and selected ferrous metals. When ferrous metals are being cast, it is important that the temperature and flow patterns of the molten casting metal be controlled so that the pipes do not fail. In this regard, cast iron, alloy iron and ductile iron can be used safely with the carbon steel seamless pipe described hereinabove. A preferred ductile iron for casting is given by the following compositions: C: 3.00 to 3.50%, Si: 2.20 to 2.60%, Mn: 0.60 to 1.00%, Ni: 1.80 to 2.20%, Cu: 0.90 to 1.20%, Mo: 0.50 to 0.75%, Cr: 0.10% maximum, P: 0.08% maximum, S: 0.01% maximum, and the balance Fe.

To those skilled in the art to which this invention appertains, the above described preferred embodiment may be subject to change or modification. Such changes or modifications can be carried out without departing from the scope of the invention, which is intended to be limited only by the scope of the appended claims.

What is claimed is:

1. A method of casting metals with integral heat exchange piping, comprising the steps of:

providing a disposable pattern;

providing at least one heat exchange pipe;

bending said at least one heat exchange pipe to a predetermined shape;

placing at least one hanger on said at least one exchange pipe;

placing said at least one heat exchange pipe inside said disposable pattern so that either end of said at least one heat exchange pipe protrudes from said disposable pattern;

providing a mold around said disposable pattern, said step of providing a mold further comprising:

providing a pipe expansion cavity in said mold adjacent each said end of said at least one heat exchange pipe; and anchoring said at least one hanger to said mold; and casting molten metal into said disposable pattern in said mold, thereby causing said disposable pattern to vaporize and said molten metal to be cast to a predetermined shape with integral heat exchange piping.

2. The method of claim 1, wherein said step of anchoring comprises connecting an anchor rod with said at least one hanger, said anchoring rod protruding out of said disposable pattern and into said mold.

3. A cast metal product produced by the method of claim 2.

4. The method of claim 1, wherein said step of providing a mold around said disposable pattern further comprises:

plugging each end of said at least one heat exchange pipe so that said molten metal will not enter said at least one heat exchange pipe during said step of casting.

5. The method of claim 4, wherein said step of providing a mold around said disposable pattern further comprises:

placing a refractory coating around said disposable pattern;

placing said disposable pattern in a drag flask;

placing foundry sand in said drag flask to provide a drag portion of said mold; said step of placing foundry sand in said drag flask further comprising the step of providing a gate in said drag portion of said mold, said gate allowing said molten metal to enter said disposable pattern during said step of casting, said molten metal entering said disposable pattern at a flow rate and under a pressure such that said at least one heat exchange pipe will not be substantially damaged by said molten metal;

placing a cope flask adjacent said drag flask;

placing foundry sand in said cope flask to provide a cope portion of said mold; said step of placing foundry sand in said cope flask further comprising the steps of:

providing at least one riser in said cope portion of said mold; and providing a sprue in said cope portion of said mold so that said molten metal may be poured into said sprue during said step of casting and said molten metal will flow through said gate into said disposable pattern.

6. The method of claim 5, wherein said step of providing a mold around said disposable pattern includes said mold surrounding at least a section of length of each said protruding end of said at least one heat exchange pipe.

7. The method of claim 6, wherein said step of providing a pipe expansion cavity adjacent each said end of said at least one heat exchange pipe comprises placing a block of preselected material at each said protruding end of said at least one heat exchange pipe to establish each said pipe expansion cavity in said mold, said material being selected to vaporize during said step of casting.

8. The method of claim 7, wherein said step of plugging each end of said at least one heat exchange pipe comprises placing wadding a predetermined distance into each said end of said at least one heat exchange pipe and placing refractory sand into each said end of said at least one heat exchange pipe.

9. The method of claim 8, wherein said step of placing at least one hanger on said at least one heat exchange pipe comprises slipping said at least one heat exchange pipe through an eye of said at least one hanger; and wherein said step of anchoring comprises connecting an anchor rod with a respective hanger of said at least one hanger, each said anchor rod protruding out of said disposable pattern, each said anchor rod further protruding out of said mold, each said anchor rod being anchored to said mold when said step of providing a mold is completed.

10. The method of claim 9, wherein said step of anchoring further comprises threadingly engaging each said anchor rod with its respective said at least one hanger.

11. The method of claim 10, wherein said step of placing at least one hanger on said at least one heat exchange pipe comprises placing at least two hangers on said at least one heat exchange pipe; said step of anchoring further comprises slipping said at least one heat exchange pipe through each eye of said at least two hangers to at least two predetermined locations on said at least one heat exchange pipe, said at least two predetermined locations on said at least one heat exchange pipe being mutually separated by a distance of substantially eighteen inches.

12. A cast metal product produced by the method of claim 11.

13. The method of claim 12, wherein said step of placing at least one heat exchange pipe inside said disposable pattern comprises cutting said disposable pattern to provide at least one groove therein, each groove of said at least one groove being for each heat exchange pipe of said at least one heat exchange pipe.

14. The method of claim 13, wherein said step of providing a disposable pattern provides a segmented disposable pattern; said step of cutting said disposable pattern comprises cutting of selected segments of said disposable pattern; and said step of placing at least one heat exchange pipe inside said pattern comprises placing one said heat exchange pipe in each of said selected segments, then fastening said segmented disposable pattern together to form a single piece disposable pattern with integral heat exchange piping.

15. A cast metal product made by the method of claim 14.

16. A method of casting metals with integral heat exchange piping, comprising the steps of:

providing a pattern;

providing at least one heat exchange pipe;

bending said at least one heat exchange pipe to a predetermined shape;

placing at least one hanger on said at least one heat exchange pipe;

providing a mold around said pattern;

withdrawing said pattern from said mold to provide a pattern cavity of predetermined shape in said mold;

placing said at least one heat exchange pipe in said pattern cavity in said mold;

providing a pipe expansion cavity in said mold adjacent each said end of said at least one heat exchange pipe;

anchoring said at least one hanger to said mold; and casting molten metal into said pattern cavity in said mold, thereby causing said molten metal to be cast to said predetermined shape of said pattern cavity and include integral heat exchange piping.

17. The method of claim 16, wherein said step of anchoring comprises connecting an anchor rod with said at least one hanger, said anchoring rod protruding out of said pattern cavity in said mold and protruding into said mold.

18. A cast metal product produced by the method of claim 17.

19. The method of claim 16, wherein said step of providing a mold around said pattern further comprises:

plugging each end of said at least one heat exchange pipe so that said molten metal will not enter said at least one heat exchange pipe during said step of casting.

20. The method of claim 19, further comprising:

providing a core print on selected opposite ends of said pattern;

placing a parting compound around said pattern;

placing said pattern in a drag flask;

placing foundry sand in said drag flask to provide a drag portion of said mold;

placing a cope flask adjacent said drag flask;

placing foundry sand in said cope flask to provide a cope portion of said mold;

removing said cope portion of said mold from adjacency with said drag portion of said mold;

withdrawing said pattern from said drag portion of said mold to provide said pattern cavity in said mold, said pattern cavity having walls of predetermined shape, said pattern cavity including a plurality of columnar indentations at predetermined locations in said mold;

covering said walls of said pattern cavity with a refractory coating;

placing said cope portion of said mold in adjacency with said drag portion of said mold;

placing said at least one heat exchange pipe in said pattern cavity in said mold, each end of said at least one heat exchange pipe resting in one said columnar indentation in said mold;

filling each said columnar indentation in said mold with foundry sand;

providing a gate in said drag portion of said mold, said gate allowing said molten metal to enter said pattern cavity in said mold during said step of casting, said molten metal entering pattern said cavity in said mold at a flow rate and under a pressure such that said at least one heat exchange pipe will not be substantially damaged by said molten metal;

providing at least one riser in said cope portion of said mold; and providing a sprue in said cope portion of said mold so that said molten metal may be poured into said sprue during said step of casting and said molten metal will flow through said gate into said pattern cavity in said mold.

21. The method of claim 20, wherein said step of providing a mold around said pattern includes said mold surrounding at least a section of length of each said end of said at least one heat exchange pipe resting in said columnar indentation of said mold.

22. The method of claim 21, wherein said step of providing a pipe expansion cavity adjacent each said end of said at least one heat exchange pipe comprises placing a block of preselected material at each said end of said at least one heat exchange pipe to establish each said pipe expansion cavity in said mold, said material being selected to vaporize during said step of casting.

23. The method of claim 21, wherein said step of plugging each end of said at least one heat exchange pipe comprises placing wadding a predetermined distance into each said end of said at least one heat exchange pipe and placing refractory sand into each said end of said at least one heat exchange pipe.

24. The method of claim 23, wherein said step of placing at least one hanger on said at least one heat exchange pipe comprises slipping said at least one heat exchange pipe through an eye of said at least one hanger; and wherein said step of anchoring comprises connecting an anchor rod with a respective hanger of said at least one hanger, each said anchor rod protruding out of said cavity of predetermined shape in said mold, each said anchor rod further protruding out of said mold, each said anchor rod being anchored to said mold before said step of casting.

25. The method of claim 24, wherein said step of anchoring further comprising threadingly engaging each said anchor rod with its respective said at least one hanger.

26. The method of claim 25, wherein said step of placing at least one hanger on said at least one heat exchange pipe comprises placing at least two hangers on said at least one heat exchange pipe; said step of anchoring further comprises slipping said at least one heat exchange pipe through each eye of said at least two hangers to at least two predetermined locations on said at least one heat exchange pipe, said at least two predetermined locations on said at least one heat exchange pipe being mutually separated by a distance of substantially eighteen inches.

27. A cast metal product produced by the method of claim 26.

* * * * *

UNITED STATES PATENT AND TRADEMARK OFFICE

CERTIFICATE OF CORRECTION

PATENT NO. : 4,865,112

DATED : September 12, 1989

INVENTOR(S) : Charles H. Schwarb and Raymond E. Schwarb

It is certified that error appears in the above-identified patent and that said Letters Patent are hereby corrected as shown below:

At column 9, the begining of line 45, delete "34'" and insert therefor —34—.

At column 9, line 47, after "The anchor rods", delete "34a" and insert therefor —34—.

At column 9, line 59, after "anchor rods", please delete "34a" and insert therefor —34—.

In Figure 14, change original numeral "34a" to numeral "34".

UNITED STATES PATENT AND TRADEMARK OFFICE

CERTIFICATE OF CORRECTION

PATENT NO. : 4,865,112

DATED : September 12, 1989

INVENTOR(S) : Charles H. Schwarb, et. al.

It is certified that error appears in the above-identified patent and that said Letters Patent is hereby corrected as shown below:

In Figure 14, change original numeral "34" to numeral "32".

Signed and Sealed this

Twenty-ninth Day of December, 1992

*Attest:*

DOUGLAS B. COMER

*Attesting Officer*

*Acting Commissioner of Patents and Trademarks*